US007309136B2

(12) United States Patent
Lei

(10) Patent No.: US 7,309,136 B2
(45) Date of Patent: Dec. 18, 2007

(54) CUP WITH A FOUNTAIN

(76) Inventor: Pingfai Lei, Block 11, Tan Tou First Industrial District, Bao An, Shenzhen, Guangdong 518105 (CN)

( * ) Notice: Subject to any disclaimer, the term of this patent is extended or adjusted under 35 U.S.C. 154(b) by 108 days.

(21) Appl. No.: 10/536,375

(22) PCT Filed: Jul. 7, 2003

(86) PCT No.: PCT/CN03/00536

§ 371 (c)(1),
(2), (4) Date: May 25, 2005

(87) PCT Pub. No.: WO2004/052155

PCT Pub. Date: Jun. 24, 2004

(65) Prior Publication Data

US 2006/0076308 A1 Apr. 13, 2006

(30) Foreign Application Priority Data

Dec. 10, 2002 (CN) ..... 02 2 50235 U

(51) Int. Cl.
*F21V 33/00* (2006.01)

(52) U.S. Cl. ..... 362/101; 362/96; 362/154

(58) Field of Classification Search ..... 362/101, 362/96, 154; 220/705; 239/29.3, 33; 446/74
See application file for complete search history.

(56) References Cited

U.S. PATENT DOCUMENTS

| | | | | | |
|---|---|---|---|---|---|
| 2,303,130 | A | * | 11/1942 | Moon | 251/238 |
| 2,544,594 | A | * | 3/1951 | Goldfarb | 446/74 |
| 3,879,885 | A | * | 4/1975 | Fabricant | 446/71 |
| 5,180,079 | A | * | 1/1993 | Jeng | 220/705 |
| 5,337,918 | A | * | 8/1994 | Wang | 220/708 |
| 5,785,406 | A | * | 7/1998 | Lee | 362/96 |
| 6,012,822 | A | * | 1/2000 | Robinson | 362/103 |

* cited by examiner

*Primary Examiner*—Jong-Suk (James) Lee
*Assistant Examiner*—Robert May
(74) *Attorney, Agent, or Firm*—Raymond Y. Chan; David and Raymond Patent Group

(57) ABSTRACT

The present invention relates to a cup or a drinking container and in particular, to a drinking cup a spouting-water and lighting effect during drinking. The cup comprises a liquid container, a liquid output pipe, a spray pipe, a lighting circuit, etc, characterized in that the spray pipe inserts between the top of the liquid container and the bottom of a liquid storage, a water ion switch is supplied inside the spray pipe and just at the middle part of it, a liquid output pipe is led out from the liquid storage. The present invention has a simple configuration and a spouting water and lighting effect compared with the prior art.

13 Claims, 3 Drawing Sheets

CUP WITH A FOUNTAIN

BACKGROUND OF THE PRESENT INVENTION

1. Field of Invention

The present relates to a kind of cup or drinking container, and more particularly, relates to a drinking mug having illuminated fountain so that when a user is sipping the water via a straw, the fountain is capable of being activated with illumination effect.

2. Description of Related Arts

For user's convenience and enjoyment, the drinking mug is embodied as a sealed container for reserving liquid, such as water, wherein a straw or a sucker is integrally built-in within the container, or inserted into the container to extend the straw from the lower portion of the container to outside. That is to say, during a drinking process, the liquid of the container could be sucked out via the straw, and the air could be exchanged into the container instead. However, there are no other functions applied on such drinking mug.

It is highly desirable to develop a drinking mug which is not only capably of facilitating the drinking process, but also having illuminative fountain so as to enhance the user's enjoyment.

SUMMARY OF THE PRESENT INVENTION

A primary object of the present invention is to provide a drinking mug having illuminative fountain so as to facilitate the user's enjoyment.

Accordingly, to achieve above object, the present invention provides a drinking mug, comprising a liquid container for reserving a predetermined volume of liquid, a liquid output duct, a spray pipe, and an illuminating electrical circuit, wherein the spray pipe is disposed at an upper portion of the container for communicating the liquid container to a liquid storage, and a water ionic switch is provided at a middle portion of the spray pipe, the liquid output duct is extended to outside from the liquid storage.

According to the present invention, two end points of the water ionic switch are respectively disposed within two sides of the spray pipe, and are further leaded into a seal chamber located between the liquid storage and top cover ff the liquid container, wherein a trigger input is disposed therein for coupling the end points. The trigger input is transmitted into the flip-flop circuit via an amplified circuit so as to manage the illumination of an emitting diode. The spray pipe disposed on the upper portion of the liquid container is inserted into a cylinder in which a sealed illuminating electrical circuit is embedded therein. Furthermore, a round pipe is telescoped into the cylinder, wherein the round pipe is communicated with the spray pipe disposed at the upper portion of the liquid container.

Here, the upper portion of the liquid container is convexly curved and integrally formed with the liquid storage, wherein a port is defined on the central portion of such convexly curved upper container, and the spray pipe is inserted into such port to communicate with the liquid storage. Preferably, the upper end of the spray pipe is defined as projected inserter, which is correspondingly mating with a recessed socket defined at the convexly curved upper portion of the liquid container. Accordingly, the cross section of the inner diameter of the spray pipe is downwardly and gradually increased, and a liquid exit is defined on the very top end of such spray pipe.

According to the present invention, the spray pipe is an elongated straight pipe and is inserted into the liquid container through the port defined on the convexly curved upper potion of the container, the faucet of the spray pipe is conically defined and is integrally extended from the upper portion of the container. The apex of such conical shaped pipe has an orifice defined thereon. It is noted that after the spray pipe is inserted into the liquid storage, the spray pipe would be disposed at a bottom surface of the liquid storage, and its faucet is adapted to couple with spray header or a horn header.

According to the present invention, the cavity of the liquid storage is smaller than the cavity of the liquid container, and the liquid outputting duct is removeably connected to the side edge of the bottom surface of the liquid storage, and such liquid output duct is inserted into a flat cylinder knob, wherein a cylindrical body is coupled to the flat cylinder knob, and is sealedly inserted into the liquid storage, wherein the cylindrical body is communicated with the liquid outputting duct. The liquid output duct is defined as spiral shaped duct, having a top exit with an elevation higher than a height of the liquid storage.

Compared with the prior art, the drinking mug of the present invention has a relatively simple structure, and facilitated with supplemental functions, such as fountain and illumination.

These and other objectives, features, and advantages of the present invention will become apparent from the following detailed description, the accompanying drawings, and the appended claims.

DETAILED DESCRIPTION OF THE PREFERRED EMBODIMENT

Figure 1:
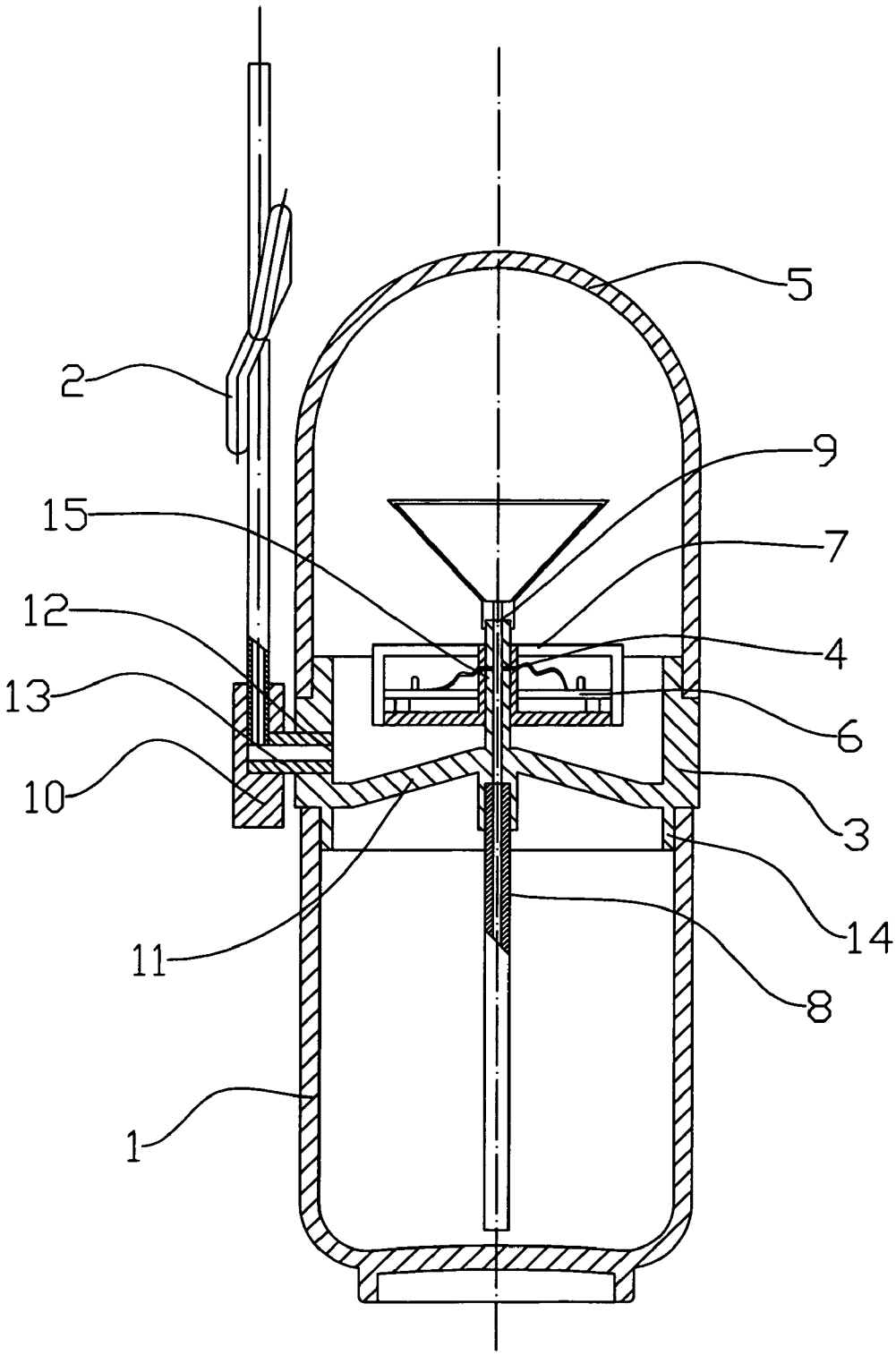
FIG. 1 is a front sectional view of the drinking mug with an illuminating fountain according to the preferred embodiment of the present invention.
Figure 2:
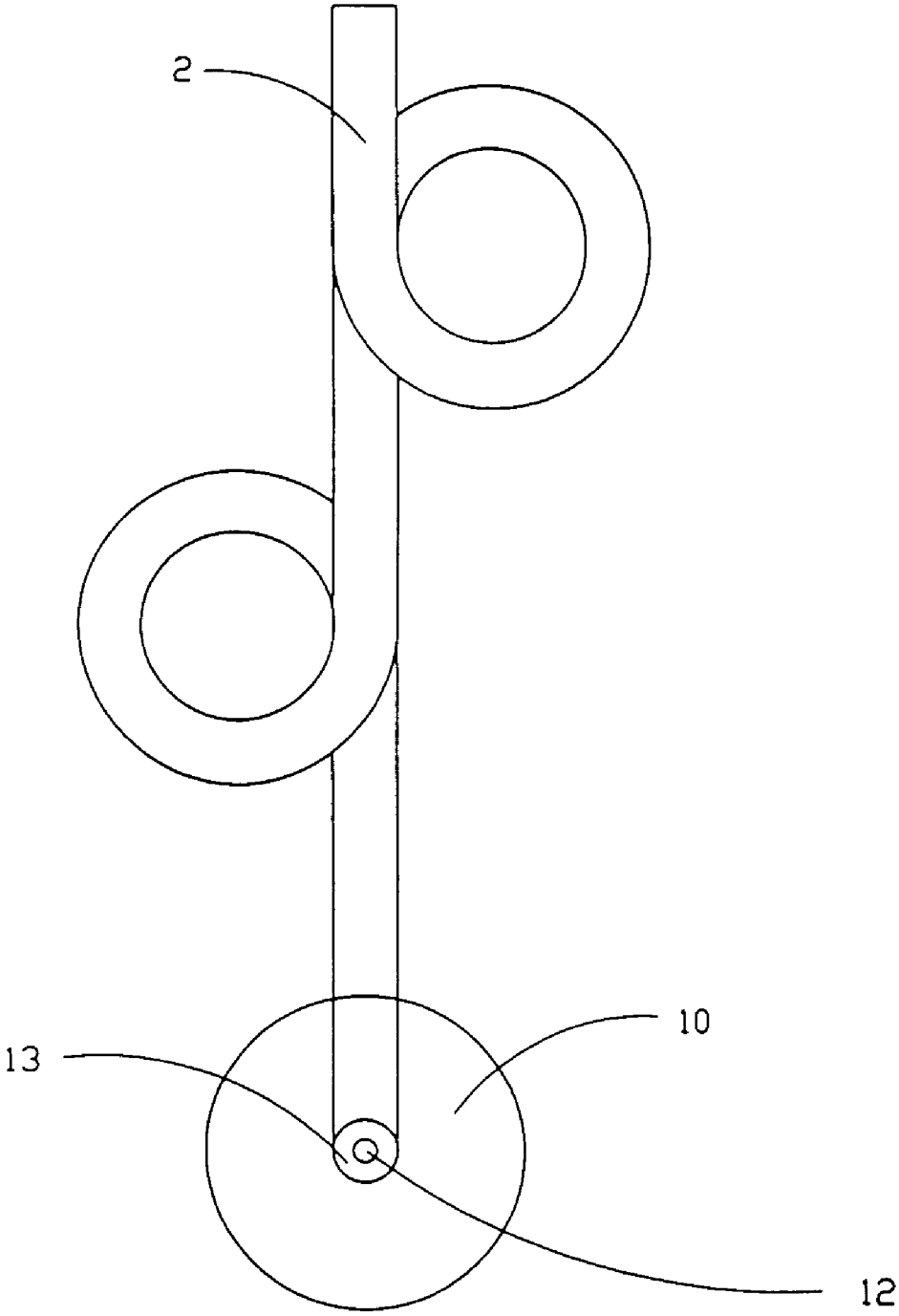
FIG. 2 is a schematic view of the liquid output duct according to the preferred embodiment of the present invention.

Referring to the FIG. 1 and FIG. 2, the drinking mug with illuminating fountain according to the preferred embodiment of the present invention is illustrated. The drinking mug comprises a liquid container 1, a liquid output duct 2, a liquid storage 3, an electrical switch 4, an top cover 5, an illuminating circuit 6, and a spray pipe 8, wherein the liquid container 1 is disposed underneath the liquid storage 3 and coupled to the liquid storage 3, a ventilating slot 14 is defined on the liquid container 1, the top portion of the liquid storage 3 is sealedly coupled the top cover 5. It is noted that the liquid container 1 and the liquid storage 3 are separated with a curved separating member 11, which is inwardly and integrally projected into the liquid storage 3. There is a port defined at a bottom side of the separating member 11 for communicating the liquid container 1 and the liquid storage via the spray pipe 8. The upper end of the spray pipe 8 is defined as projected inserter which is correspondingly matching with a recessed shaped socket defined at the curved separating member 11, which in turn disposed at the upper portion of the liquid container 1. The inside diameter of spray pipe 8 is downwardly and gradually reduced, and a water exit 9 is defined at the every top end of such spray pipe 8. Or otherwise, the spray pipe 8 is straight defined and directly inserted into the port opened at the central portion of the separating member 11. Or otherwise, the port provided at the central portion of the separating member 11 could be conically shaped, and the water exit 9 could be defined at the apex of such conical port. The spray pipe 8 is inserted into the bottom surface of the liquid storage 3, and the faucet of the spray pipe 8 could be coupled to a spray head or horn head. There is a water ionic switch 4 provided at a middle portion of the spray pipe 8, and a liquid output duct is extended from the liquid storage.

According to the present invention, two end points of the water ionic switch 4 are respectively attached onto two sides of the spray pipe 8, wherein the end points are directed into a seal chamber disposed at an upper portion of the liquid storage, wherein a trigger input of the illuminating circuit 6 is provided for coupling the end points. Furthermore, the trigger input is amplified to a flip-flap circuit IC so as to control an emitting diode to perform an illumination. There is a cylinder 4, disposed within the seal chamber 7, wherein a round pipe 15 is telescoped into the cylinder 4, and the round pipe 15 is coupled to spray pipe 8, such that the spray pipe 8 could be inserted into the cylinder 4 wherein the sealed illuminating circuit is provided therein.

The inside cavity of the liquid storage 3 is relatively smaller than that of the liquid container 1, and the bottom side edge 12 of the inner cavity of such liquid storage 3 is connected to the liquid output duct 2. It is noted that the liquid output duct 2 is movably coupled to the side edge 12 for ensuring the liquid output duct being rotatably inserted into the liquid storage 3. The liquid output duct 2 is inserted into a flat cylinder shaped knob 10, wherein a cylindrical body 13 is laterally connected to such flat cylinder shaped knob, and the cylindrical body 13 is sealedly inserted into the liquid storage 3. via a sealing gasket. As a result, by manually rotating such flat cylinder knob, the liquid output duct 2 could be pivotally rotated with respect to the fluid container 1. Here, the liquid output duct is a spiral shaped pipe extended at an outside of the liquid storage 3. It is worth to mention that the exit of the liquid output duct is defined at an elevation higher than the height of the liquid storage 3.

Whenever the liquid output duct 2 was sucked by a user, the suction pressure of the liquid storage would be significantly increased, as a result, the liquid reserved within the liquid container 1 would be upwardly flowed along the spray pipe 8 as well. During such flowing process, two end points of the water ionic switch defined at two sides of the spray pipe would be electrically conducted. Therefore the triggering signal would be directed into the trigger input of illumination circuit provided within the seal chamber 7 of the liquid storage 3. Finally, the trigger input would be amplified and transmitted into the flip-flop circuit IC so as to manage the illumination of the emitting diode.

What is more, since the inner diameter of the spray pipe 8 is downwardly and gradually increased, and a the water exit 9 is defined at the very top end of the spray pipe 8, a pressure difference would be generated at the top end of the spray pipe 8, thus forcing the water flowing at the top end of the spray pipe to be abruptly splashed to form a fountain. The spiral shaped liquid output duct further facilitates the fountain effects. It is noted the spiral shaped liquid output duct 2 is adapted to lead liquid flowing to the upper portion of the mug body, wherein the water exit 9 is defined at an elevation higher than a height of the mug body for ensuring a user comfortably suck the liquid from the liquid output duct 2.

Figure 3:
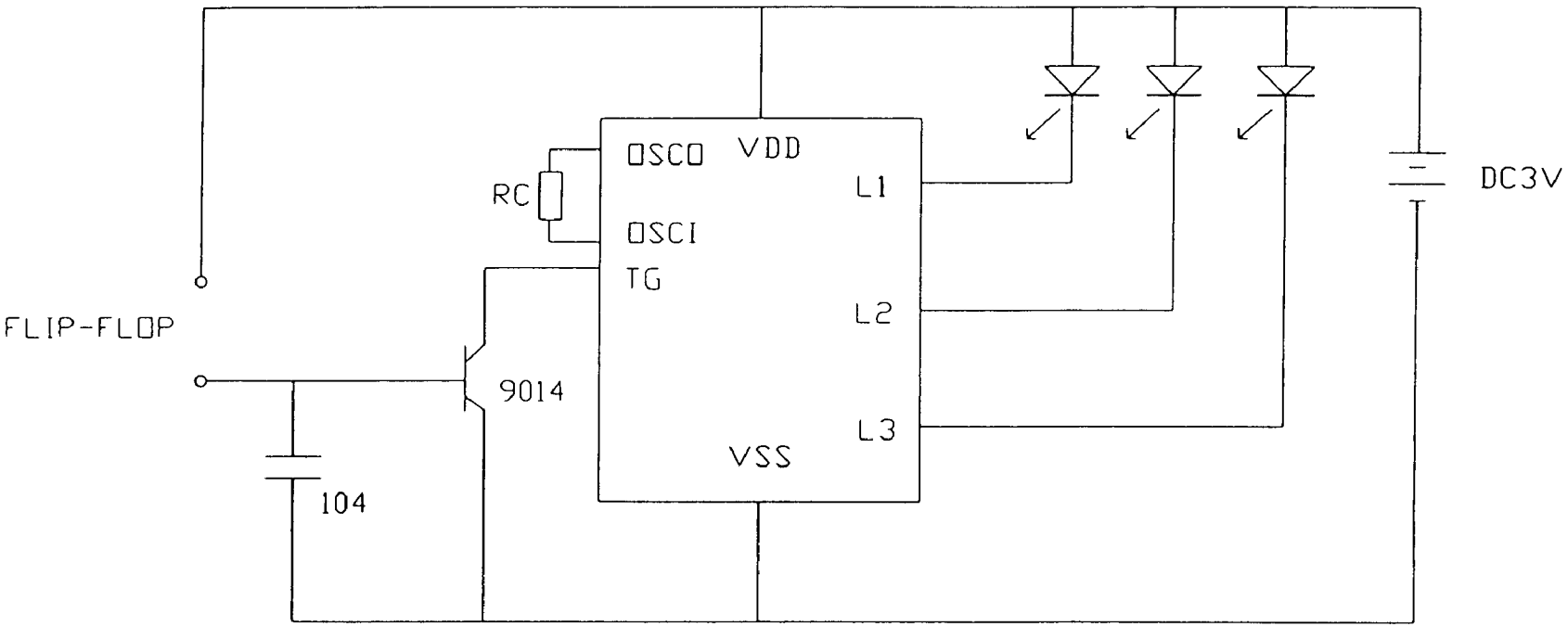
FIG. 3 is an electrical diagram of the illumination circuit according to the preferred embodiment of the present invention.

As shown in FIG. 3, the trigger inputs of the water ionic switch is filtered first via a capacity C104, and then send to the triode amplifying circuit 9014, which in turn send the amplified signal to flip-flop circuit IC through collector electrode of the triode. The outputting terminals L1, L2, L3 are adapted to control the emitting diode to illuminate.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A drinking cup, comprising:

a liquid container for reserving a predetermined volume of liquid;

a liquid storage supported above said liquid container;

a curved separating member inwardly and integrally projected into said liquid storage as a bottom wall thereof to separate said liquid storage from said liquid container, wherein said separating member has a port provided at a center of said separating member, wherein a top end of said port is extended above said liquid storage to define a water exit at said top end of said port;

a liquid output duct communicatively extended from said liquid storage;

a spray pipe having an upper end inserted into said separating member at a bottom end of said port thereof and a bottom end extended within said liquid container for communicating said liquid container to said liquid storage;

an illuminating electrical circuit sealed and disposed within said liquid storage; and a water switch having two end points provided at two sides of said port and arranged in such a manner that when a suction effect is created at said liquid storage via said liquid output duct, said liquid is sucked from said liquid container to said liquid storage through said spray pipe to create a fountain effect at said water exit, while said two end points of said water switch are electrically connected to activate said illuminating electrical circuit for generating a light effect.

2. The drinking cup, as recited in claim 1, wherein illuminating electrical circuit comprises a plurality of LEDs, a flip-flop circuit and an amplified circuit, wherein when said end points of said water switch is electrically conducted, a trigger input is transmitted to said flip-flop circuit via amplified circuit to control an illumination of said LEDs.

3. The drinking cup, as recited in claim 1, further comprises a seal chamber provided within said liquid storage, wherein said illuminating electrical circuit and said water switch are received in said seal chamber that said two end points of said water switch are attached to two sides of said port within said seal chamber.

4. The drinking cup, as recited in claim 1, further comprising a device for rotatably coupling said liquid output duct with a bottom side edge of said liquid storage, wherein said device comprises a cylindrical body sealed and extended from said bottom side edge of said liquid storage and a cylinder knob connected to said cylindrical body, wherein an end of said liquid output duct is inserted into said cylinder knob to communicate with said cylindrical body such that when said cylinder knob is rotated, said liquid output duct is rotated with respect to said liquid container.

5. The drinking cup, as recited in claim 1, further comprising a spray head mounted at said water exit for splashing said liquid thereat to generate said fountain effect.

6. The drinking cup, as recited in claim 1, wherein said separating member has a conical shape defining said top end at a center of said separating member and a socket provided at said center of said separating member, wherein said spray pipe has a projected inserter which is formed at said upper end of said spray pipe and is inserted into said socket of said separating member such that said spray pipe is downwardly extended from said center of said separating member to a bottom surface of said liquid container.

7. The drinking cup, as recited in claim 6, further comprising a device for rotatably coupling said liquid output duct with a bottom side edge of said liquid storage, wherein said device comprises a cylindrical body sealed and extended from said bottom side edge of said liquid storage and a cylinder knob connected to said cylindrical body, wherein an end of said liquid output duct is inserted into said cylinder knob to communicate with said cylindrical body such that when said cylinder knob is rotated, said liquid output duct is rotated with respect to said liquid container.

8. The drinking cup, as recited in claim 6, further comprises a seal chamber provided within said liquid storage, wherein said illuminating electrical circuit and said water switch are received in said seal chamber that said two end points of said water switch are attached to two sides of said port within said seal chamber.

9. The drinking cup, as recited in claim 8, wherein illuminating electrical circuit comprises a plurality of LEDs, a flip-flop circuit and an amplified circuit, wherein when said end points of said water switch are electrically connected, a trigger input is transmitted to said flip-flop circuit via amplified circuit to control an illumination of said LEDs.

10. The drinking cup, as recited in claim 8, further comprising a device for rotatably coupling said liquid output duct with a bottom side edge of said liquid storage, wherein said device comprises a cylindrical body sealed and extended from said bottom side edge of said liquid storage and a cylinder knob connected to said cylindrical body, wherein an end of said liquid output duct is inserted into said cylinder knob to communicate with said cylindrical body such that when said cylinder knob is rotated, said liquid output duct is rotated with respect to said liquid container.

11. The drinking cup, as recited in claim 10, further comprising a spray head mounted at said water exit for splashing said liquid thereat to generate said fountain effect.

12. The drinking cup, as recited in claim 10, wherein illuminating electrical circuit comprises a plurality of LEDs, a flip-flop circuit and an amplified circuit, wherein when said end points of said water switch are electrically connected, a trigger input is transmitted to said flip-flop circuit via amplified circuit to control an illumination of said LEDs.

13. The drinking cup, as recited in claim 12, further comprising a spray head mounted at said water exit for splashing said liquid thereat to generate said fountain effect.

* * * * *